US005655956A

United States Patent [19]

Ferreira et al.

[11] Patent Number: 5,655,956

[45] Date of Patent: Aug. 12, 1997

[54] ROTARY ULTRASONIC GRINDING APPARATUS AND PROCESS

[75] Inventors: Placid M. Ferreira, Champaign, Ill.; Nitin Khanna, Greenville, S.C.; Zhijain Pei, Urbana, Ill.

[73] Assignee: University of Illinois at Urbana-Champaign, Urbana, Ill.

[21] Appl. No.: 447,780

[22] Filed: May 23, 1995

[51] Int. Cl.[6] ..... B24B 5/00; B24B 37/00

[52] U.S. Cl. ..... 451/143; 451/165; 451/255; 451/388

[58] Field of Search ..... 451/165, 119, 451/143, 155, 910, 449, 988, 268, 269, 285, 272, 274

[56] References Cited

U.S. PATENT DOCUMENTS

| | | | |
|---|---|---|---|
| 4,100,701 | 7/1978 | Bessaguet | 451/165 |
| 4,916,868 | 4/1990 | Wittstock . | |
| 5,035,087 | 7/1991 | Nishiguchi et al. | 451/285 |
| 5,062,384 | 11/1991 | Foley et al. | 451/388 |
| 5,205,077 | 4/1993 | Wittstock . | |
| 5,305,556 | 4/1994 | Kopp et al. | 451/165 |
| 5,355,755 | 10/1994 | Sakata et al. | 451/165 |

FOREIGN PATENT DOCUMENTS

| | | | |
|---|---|---|---|
| 362188657 | 8/1987 | Japan | 451/269 |
| 363196359 | 8/1988 | Japan | 451/269 |

OTHER PUBLICATIONS

Khanna, Nitin, *Rotary Ultrasonic Grinding of Ceramics*, thesis submitted 1995.

Bifano, T.G. et al., *Journal of Engineering for Industry*, "Ductile–Regime Grinding: A New Technology for Machining Brittle Materials", vol. 113, pp. 184–189 (May 1991).

Cook, Robert F. et al., *Journal of the American Ceramic Society*, "Direct Observation and Analysis of Indentation Cracking in Glasses and Ceramics", vol. 73, No. 3, pp. 787–817 (1990).

Kainth, G. S., et al., *Int. J. Mach. Tool Des. Res.*, "On the Mechanics of Material Removal in Ultrasonic Machining", vol. 19, pp. 33–41 (1979).

Komaraiah, M. et al., *Int. J. Prod. Res.*, "Rotary Ultrasonic Machining—a new cutting process and its performance", vol. 29, No. 11, pp. 2177–2187 (1991).

Komaraiah, M. et al., *Int. J. Mach. Tools Manufact.*, "A Study on the Influence of Workpiece Properties in Ultrasonic Machining", vol. 33, No. 3, pp. 495–505 (1993).

Lawn, B.R. et al. "Elastic Plastic Indentation Damage In Ceramics: The Median/Radial Crack System".

Markov, A.I., et al., *Industrial Diamond Review*, "A Study of the Ultrasonic Diamond Drilling of Non–Metallic Materials", pp. 97–99 (Mar. 1972).

Marshall, D.B., et al., *Journal of Materials Science*, "Residual Stress Effects in Sharp Contact Cracking", pp. 2001–2012 (1979).

Marshall, D.B., et al., *Journal of the American Ceramic Society*, "Elastic/Plastic Indentation Damage in Ceramics: The Lateral Crack System", vol. 65, No. 11, pp. 561–566 (May 1981).

Miller, George E., *Journal of Applied Physics*, "Special Theory of Ultrasonic Machining", vol. 28, No. 2, pp. 149–156 (Feb. 1957).

(List continued on next page.)

*Primary Examiner*—Robert A. Rose
*Assistant Examiner*—George Nguyen
*Attorney, Agent, or Firm*—Testa, Hurwitz & Thibeault, LLP

[57] ABSTRACT

The invention relates to an apparatus and process for machining a rotating workpiece by means of rotary ultrasonic grinding. The apparatus performs rotary ultrasonic grinding by rotating and vibrating a surface finishing tool in contact with a rotating workpiece. The rotary ultrasonic grinding process is a hybridized method which comprises a combination of conventional ultrasonic machining and diamond grinding. Important parameters in one embodiment of the process include ultrasonic vibration amplitude and frequency, static pressure or force, tool rotation speed, workpiece rotation speed, grit size, grit concentration, abrasive type, and bond type.

12 Claims, 6 Drawing Sheets

OTHER PUBLICATIONS

Pei, Z.J., et al., *Int. J. Mach. Tools Manufact.,* "Rotary Ultrasonic Machining for Face Milling of Ceramics", vol. 35, pp. 1033–1046 (1995).

Pei, Z.J., et al., *Transactions of the ASME,* "A Mechanistic Approach to the Prediction of Material Removal Rates in Rotary Ultrasonic Machining", vol. 117, pp. 142–151 (May 1995).

Ponton, C.B., et al., *Mater. Sci. Tech.,* "Dependence of the Vickers Indentation Fracture Toughness on the Surface Crack Length", pp. 83–91 (1989).

Shaw, Milton C., *Microtechnic,* "Ultrasonic Grinding", vol. 10, No. 6, pp. 257–265 (1956).

Sheldon, G.L., et al., *Journal of Engineering for Industry* "The Mechanism of Material Removal in the Erosive Cutting of Brittle Materials", pp. 1–7 (1965).

Soundararajan, V., et al., *Int. J. Mach. Tool Des. Res.,* "An Experimental Investigation On The Basic Mechanisms Involved In Ultrasonic Machining", vol. 26, No. 3, pp. 307–321 (1986).

Tyrrell, William R., *Machining Hard Materials,* "Rotary Ultrasonic Machining", pp. 83–91.

Wang, J.C., et al., *Journal of Tribology,* "Chemically Assisted Machining of Ceramics", vol. 116, pp. 423–429 (Jul. 1994).

ROTARY ULTRASONIC GRINDING APPARATUS AND PROCESS

BACKGROUND OF THE INVENTION

1. Field of the Invention

The present invention relates to an improved method and apparatus for machining by means of rotary ultrasonic grinding ceramic disks that are used as substrates for computer hard disks. In general, rotary ultrasonic machining (RUM) has the potential for high material removal rates (MRR) while maintaining low cutting pressures and causing little sub-surface damage, which in turn results in little strength reduction in the workpiece being machined. The present invention implements RUM in a novel manner using a diamond grinding tool on a horizontal spindle-type machine to provide rotary ultrasonic grinding of a rotating ceramic disk substrate. The resulting disks are machined faster than with conventional methods, with a high degree of straightness and parallelism and with few defects.

2. Description of the Related Art

Advanced ceramics are increasingly used for numerous commercial applications in the aerospace, automotive, electronics and cutting tools industry. The inherent mechanical and thermal properties of the advanced ceramics (such as chemical inertness, high strength and stiffness at elevated temperatures, high strength to weight ratio, high hardness, corrosion resistance, and oxidation resistance) result in superior performance, which in turn, translates to significant cost savings.

The very properties of ceramics that make them attractive from a product performance standpoint are also responsible for difficulties encountered in shaping or machining them to a precise size and shape. Studies have concluded that the machining cost can be as high as 90% of the total cost of some ceramic components (see Jahanmir et al., "Ceramic Machining: Assessment of Current Practice and Research Need in the United States", *NIST Special Publication,* p. 834 (1992)). Additionally, the machining or shaping process is often responsible for strength degradation of the ceramic material. This can increase the susceptibility of the ceramic components to sudden failure, therefore decreasing their reliability.

Conventional ceramic products are usually sintered powder compacts. During the sintering process, shrinkage of materials cannot be avoided, making machining necessary to obtain proper dimensions (see Anantha Ramu et al., "Machining Performance of Toughened Zirconia Ceramic and Cold Compact Alumina Ceramic in Ultrasonic Drilling", 20 *Journal of Mechanical Working Technology* pp. 365–75, (1989)). Machining at high material removal rates (MRR) is desirable for manufacturing efficiency. There is therefore a crucial need for the development of processes which are capable of relatively high material removal rates while producing relatively little surface and sub-surface damage to the ceramic parts.

One possible application of ceramics is in the computer hardware industry. Magnetic computer hard disks are commonly manufactured with an aluminum substrate. Aluminum substrate disks generally do not provide the structural rigidity, flatness, and smoothness required for certain computer hardware applications. Because of the high strength to weight ratio of ceramics, the disk industry is actively pursuing replacement of the aluminum substrate with a ceramic one. The primary concern is the high cost of machining ceramics, particularly because tolerances on straightness and parallelism in computer hard disks are held typically to plus or minus 5 μm (0.0002 in.), which requires lower MRR and therefore longer machining cycles using conventional machining by a diamond grinding, lapping, and polishing process. Disk manufacturers therefore seek a more efficient ceramic machining process.

Reports of conventional ultrasonic machining appeared in literature in the early 1960's (see "Ultrasonic Drilling with a Diamond Impregnated Probe", *Ultrasonics,* 1–4 (January–March 1964)). Such machining turned out to be an attractive proposition for machining hard and brittle materials, especially glass and ceramics. The performance of the process was found to improve with increasing hardness of the workpiece material. However, the material removal rates of this process were low.

RUM has recently been adapted for drilling and face milling of ceramics. (See Tyrell, "Rotary Ultrasonic Machine", presented at SME's Nontraditional Machine Seminar, (January 1970); Prabhakar, "Machining Advanced Ceramic Materials Using Rotary Ultrasonic Machining Process", M.S. Thesis, University of Illinois at Urbana-Champaign (1992). See also, Pei et al., "Rotary Ultrasonic Machining for Face Milling of Ceramics", accepted for publication in *International J. of Mach. Tools and Mfg.* (1995)). The results have been very promising in terms of achieving high MRR with minimal surface damage. RUM processes, however, generally require the use of a large tool and keeping the workpiece stationary to complete the machining task. Milling processes typically require manually moving the workpiece under the tool; thus, resulting in longer machining cycle times.

Accordingly, there is a need to provide an accurate, higher speed method of machining ceramic disks for use as computer disks to narrow tolerances of straightness and parallelism.

Therefore it is an object of this invention to provide an accurate, relatively high speed method of machining ceramic disks to narrow tolerances of straightness and parallelism.

It is a further object of this invention to provide high speed machining of ceramic disks with minimal subsurface damage caused by machining.

It is another object of this invention to provide an ultrasonic machining method that does not cause tool glazing.

It is still another object of this invention to provide ultrasonic machining of ceramics without the use of an abrasive slurry.

It is also an object of this invention to provide a machine for accurate, high speed grinding of ceramic disks.

It is still a further object of this invention to provide a ceramic disk having narrow tolerances of straightness and parallelism.

SUMMARY OF THE INVENTION

These and other objects of the present invention are met by providing a rotary ultrasonic grinding method and apparatus for producing a ceramic disk having narrow tolerances of straightness and parallelism.

The rotary ultrasonic grinding process of the invention is in part a combination of the ultrasonic machining process and the diamond grinding process. Together with the apparatus of the invention, the process rough finishes a ceramic disk to a high degree of straightness and parallelism with minimal subsurface damage caused by machining.

The apparatus of the invention in one particular embodiment includes a rotatable surface finishing tool, an ultrasonic generator, a motor, a feed system, a rotatable work head, and a motor or similar device for rotating the work head. The rotatable surface finishing tool is specially designed to include an abrasive such as a face-grinding diamond metal matrix bond, affixed to its outer surface. The tool receives rotational motion via a motor connected to it, and the ultrasonic generator located on the tool causes it to vibrate axially. This tool configuration and operation improves the material removal rate (MRR) and inhibits tool glazing. Additionally, the tool design may allow coolant to be fed through the tool internally to cool it and to wash away the grinding swarf (or waste) generated during the RUG process. The tool is specified to a desired grit size and an ultrasonic tunable weight.

In a preferred embodiment, the tool is attached to an ultrasonic spindle such that they move in synchronized motion. The rotatable ultrasonic spindle is mounted on a horizontal air-actuated machine base, and includes a motor which supplies rotational motion to the spindle and tool. Different rotational speeds can be obtained by adjusting the motor speed using a motor speed controller. The ultrasonic spindle also includes an ultrasonic vibration generator which causes axial vibration of the spindle and tool. The ultrasonic generator may be a piezoelectric transducer located in the ultrasonic spindle. The transducer converts electrical input from a power supply into mechanical vibrations. The magnitude of the mechanical vibrations can be varied by changing the output setting of the power supply.

A constant pressure feed system brings the ultrasonic spindle/diamond tool assembly and the workpiece into contact with one another. The feed system applies a constant pressure to the ultrasonic spindle/tool assembly to bring it to the workpiece. The feed system comprises two linear slides, an actuating circuit, and support fixtures. The x-axis of the feed system includes a work table mounted on ball bushings which travel on two precision way slides. The work table is fed by an air cylinder driven by an actuating circuit. The actuating circuit includes a pressure regulator, pressure gauge, and a three port-two way valve.

During the RUG process, a ceramic disk workpiece is secured in a vacuum chuck by vacuum pressure. The vacuum chuck incorporates an aluminum body with a ceramic face insert to guard against dampening of the ultrasonic energy. The vacuum chuck is mounted in a rotatable work head which rotates about an axis parallel to and offset from the axis of rotation of the surface finishing tool. A motor or similar device supplies the work head with rotational motion. During the process, the work head provides rotational motion to the workpiece.

The RUG apparatus also includes coolant system for cooling the tool during the process. The coolant system comprises a simple coolant pump, a coolant tank, and a distribution circuit.

The important parameters of the process of the invention include ultrasonic vibration amplitude, static pressure or force, rotating speed of the tool, rotating speed of the workpiece, grit size, grit concentration, diamond type, bond type, and frequency of the vibrations.

The present invention is further described in reference to the attached drawings.

DETAILED DESCRIPTION OF THE INVENTION

Figure 1:
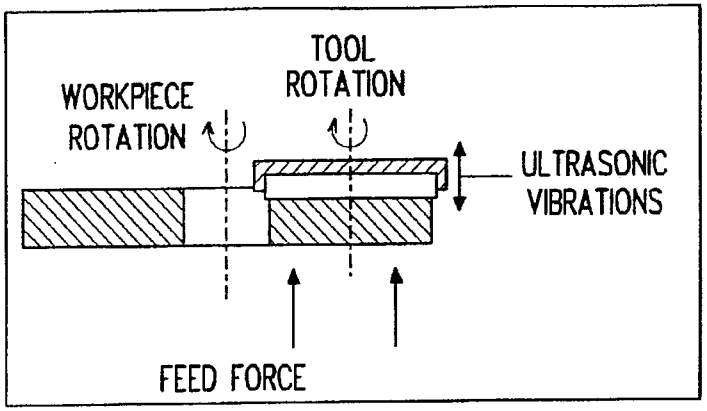
FIG. 1 is a cross-sectional schematic view of the setup of the rotary ultrasonic grinding apparatus of the present invention.

This invention relates to a rotary ultrasonic grinding (RUG) apparatus and process. The apparatus performs RUG by rotating and vibrating a surface finishing tool in contact with a rotating workpiece. The apparatus rough finishes the surface of the workpiece by subjecting it to plastic deformation and/or shear forces. One of skill in the art will appreciate that with proper tool design and parameter selection a final surface finish may be achieved.

The RUG machining process is a hybridized method which comprises a combination of conventional ultrasonic machining and diamond grinding. Important parameters in one embodiment of the rotary ultrasonic grinding process include ultrasonic vibration amplitude and frequency, static pressure or force, tool rotation speed, workpiece rotation speed, grit size, grit concentration, abrasive type, and bond type. The RUG process achieves high material removal rates while maintaining low cutting pressures and little subsurface damage to the workpiece.

An exemplary embodiment of the RUG apparatus includes a rotatable ultrasonic spindle, a rotatable surface finishing tool, a motor, an ultrasonic generator, a constant pressure feed system, and a rotatable work head. The ultrasonic spindle is mounted to a base attached to the frame of the RUG apparatus, and is designed to rotate and vibrate axially. The spindle is mounted to a work table, and it supports the surface finishing tool such that the tool rotates and vibrates simultaneously with the spindle.

The surface finishing tool is attached to an end of the spindle. The spindle and tool, however, may be integrally formed to create a unitary structure. The tool is a specially designed face grinding device having grinding type abrasives such as a grinding diamond matrix attached to its outer surface. Of course, other suitable abrasives may be used, including, without limitation, cubic boron nitride and boron carbide. The tool can be specified to a desired grit size and a desired weight. The weight of the tool is selected to "tune" the tool to the ultrasonic frequencies being used. For the purposes of this specification, the weight of the tool is referred to as "the ultrasonic tunable weight".

A motor connected to the spindle causes the rotation of both the tool and spindle. As discussed below, tool rotation speed is an important factor in effectively machining the workpiece. An increase in tool speed causes an increase in the material removal rate (MRR). The rotational speed of the spindle and tool can be adjusted by varying the speed of the motor using commonly known techniques such as a motor speed regulator.

An ultrasonic vibration generator located in the spindle causes both the spindle and tool to vibrate at ultrasonic frequencies. Typically, the generator converts an input energy signal to mechanical vibrations. The amplitude and frequency of the mechanical vibrations are important factors in achieving acceptable machining of the workpiece. These factors may be controlled by varying the magnitude and frequency of the energy input into the generator.

RUG surface finishing begins when the tool contacts a rotating workpiece. The feed system repositions the spindle and tool relative to the workpiece. The feed system includes a means for moving the spindle such that the tool may contact the workpiece surface to be machined. The feed system maintains constant pressure on the spindle and tool during the RUG process, and includes a work table, one or more linear slides, a cylinder, and an actuating circuit. The feed system also may be designed to bring the workpiece into contact with the tool. Friction caused by the contact of the tool and workpiece causes the surface finishing tool to heat-up, and it is cooled during the process by a coolant system.

The RUG apparatus and process will be understood by reference to the drawings. FIG. 1 illustrates the movement of the tool and workpiece. As shown, the workpiece rotates about an axis which is offset from and parallel to the tool's axis of rotation. The tool vibrates along its axis of rotation, and is subjected to a constant feed force which brings it into contact with the workpiece.

FIG. 2 shows an exemplary embodiment of the RUG apparatus 10. The apparatus 10 includes three subsystems: a rotary ultrasonic spindle kit 14, a feed system 28, and a coolant system 60. The ultrasonic spindle kit 14 performs the actual machining of the workpiece 12, and the feed system 28 brings the spindle kit 14 into contact with the workpiece 12. The coolant system 60 circulates a coolant fluid to the spindle kit 14.

Figure 3:
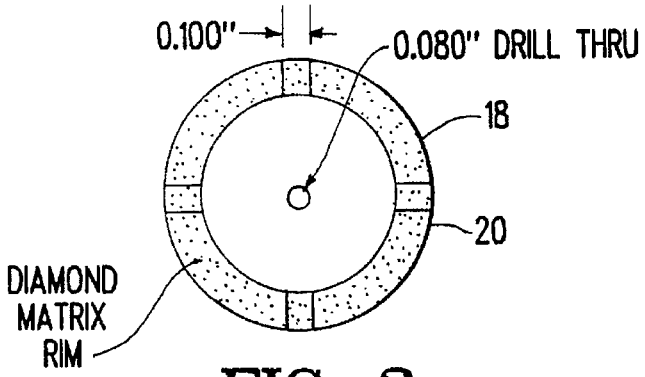
FIG. 3 is a cross-sectional bottom view of an ultrasonic diamond grinding tool for use in the rotary ultrasonic grinding apparatus and process of the present invention.

The ultrasonic spindle kit 14, performs RUG by simultaneously rotating and vibrating a surface finishing tool 18 against a rotating workpiece 12. The spindle kit 14 includes a rotary ultrasonic spindle 16, a surface finishing tool 18, an ultrasonic transducer (not shown), and an electric motor 22. The ultrasonic spindle 16 is secured to the machine base 58 and supports the surface finishing tool 18, the transducer, and the motor 22. The surface finishing tool 18 is attached to an end of the ultrasonic spindle 16 and contains grinding abrasives 20 attached to its outer surface (see FIG. 3). The abrasives 20 are grinding diamonds having a metal matrix bond. The grit size of the abrasives 20 is an important parameter in removing material from the machined surfaced. As will be discussed in the example, the grit size may have a strong influence on material removal rates. For example, MRR tends to be higher with larger and more concentrated grit. Larger or coarser grit can be considered as large indenters associated with larger crack systems.

The electric motor 22 is attached to an opposite end of the spindle 16 and causes the axial rotation of both the spindle 16 and tool 18. The rotational speed of the spindle 16 and finishing tool 18 is controlled by regulating the speed of the motor 22 using a motor speed regulator (not shown). As stated in the example, tool 18 rotation is an important factor in obtaining effective material removal rates during the RUG process.

Figure 5:
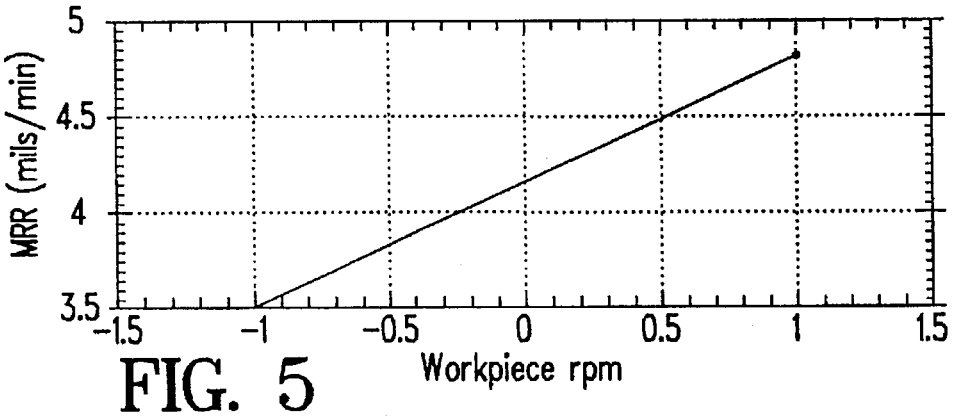
FIG. 5 is a graph showing the experimentally determined variation of MRR with chuck speed.

The ultrasonic transducer is located inside the ultrasonic spindle 16, and it causes the ultrasonic spindle 16 and the surface finishing tool 18 to vibrate along the rotational axis of the ultrasonic spindle 16. The transducer is a piezoelectric transducer which converts an electrical input into mechanical vibrations. In an exemplary embodiment, a switching power supply 24 converts a 50 Hz electrical power signal to an AC output having a frequency of approximately 20 kHz. The transducer converts this signal to ultrasonic vibrations which cause the spindle 16 and surface finishing tool 18 to vibrate. The vibration amplitude of the tool 18 is an important factor in achieving adequate material removal from the workpiece 12. The two level interaction between the speed and the vibration amplitude of the tool 18 is illustrated in FIG. 5 and discussed below.

Figure 2A:
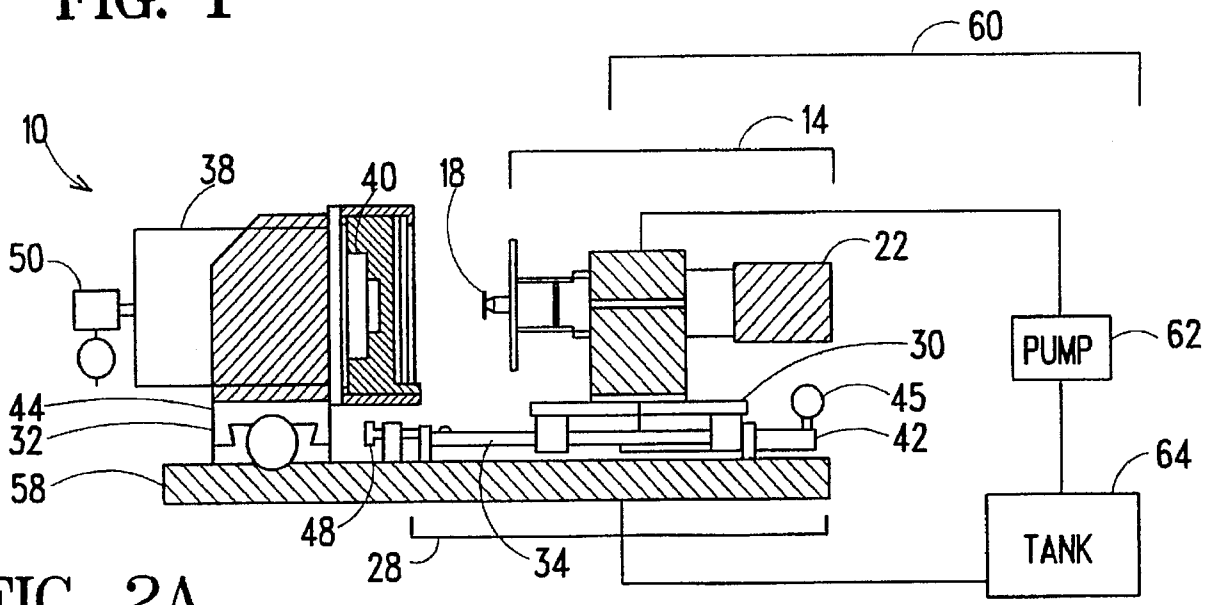
FIGS. 2A, 2B, and 2C are cross-sectional side views of the horizontal rotary ultrasonic grinding apparatus of the invention in the neutral position, as the tool is fed to the workpiece, and in the grind mode.
Figure 2B:
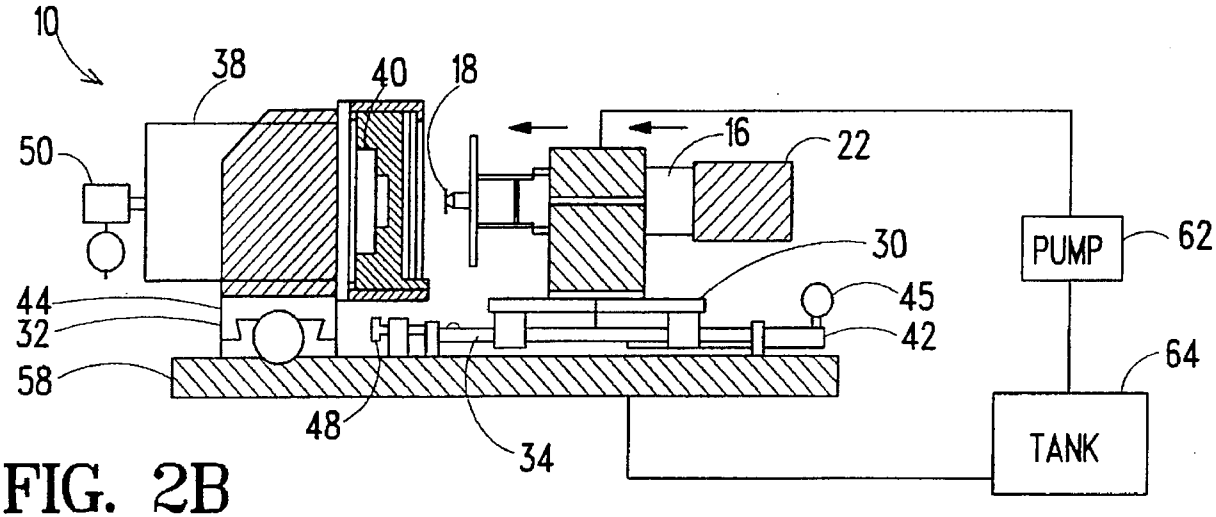
Figure 2C:
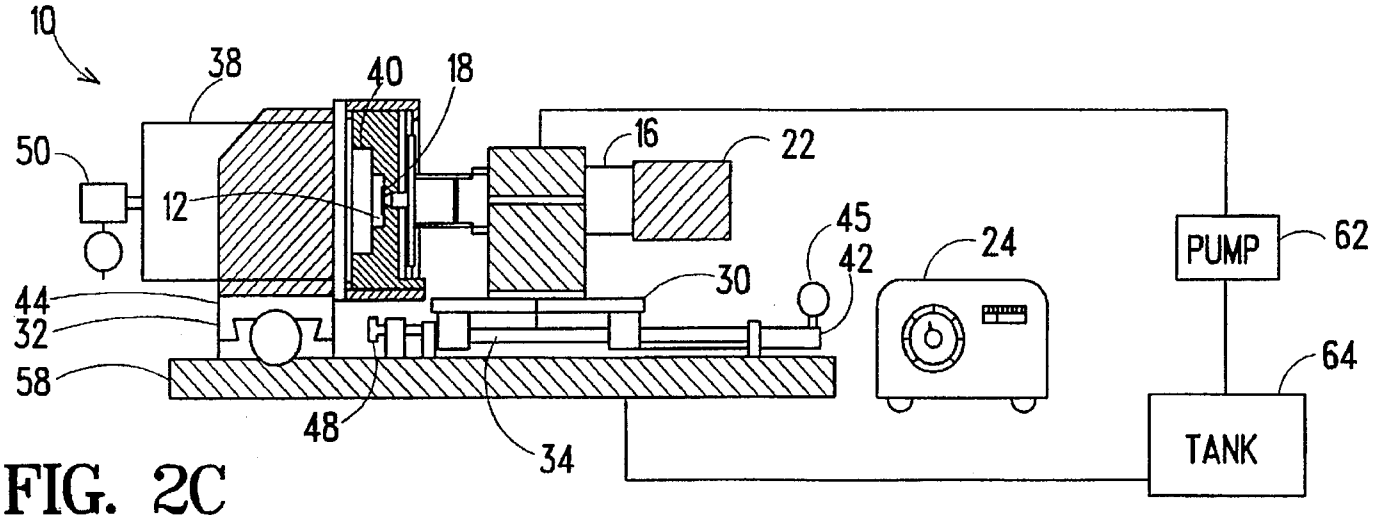

The feed system 28 brings the tool 18 into the workpiece 12. The feed system 28 is a constant pressure system wherein the feed pressure is controlled rather than the feed rate. The feed (static) pressure is preset prior to the start of the grinding cycle and is regulated by a feed control panel. FIG. 2A shows the spindle 16 in the neutral position, feed system 28 inactive. FIG. 2B shows the feed direction of the apparatus 10 when the feed system 28 is active, and FIG. 2C shows the apparatus 10 in the grinding position. As will be illustrated, the feed pressure is an important parameter in obtaining effective material removal rates during the RUG process.

The feed system 28 comprises a work table 30 mounted on one or more linear slides 34, a cylinder 42, and an actuating circuit for propelling the work table 30. One of skill in the art will appreciate that the feed system may comprise any constant pressure feed system which is capable of permitting the ultrasonic spindle 16 and/or workpiece 12 to change position relative to the one another. Such systems may include a lead screw slide with a force feedback which controls the rotational speed of the lead screw.

In the embodiment of FIGS. 2A, 2B, and 2C, the spindle 16 is attached to the work table 30 which is mounted on the slide 34. The work table 30 is mounted on ball bushings, and the cylinder 42 causes it to move along the slide 34, repositioning the spindle 16 horizontally along the x-axis of the RUM apparatus 10. The cylinder 42 is a pneumatic piston cylinder which includes a cylinder head and rod. One surface of the cylinder 42 is attached to the machine base 58 and another surface is attached to the work table 30. The actuating circuit directs pressurized air into the cylinder air feed 45. The pressurized air causes the cylinder rod to extend. The extension of the cylinder rod propels the work table 30 along the slide 34. The depth control 48 regulates the movement of the cylinder 42 relative to the workpiece 12.

The actuating circuit regulates the air pressure to the cylinder 42, and it comprises a pressure regulator, a pressure gauge, and a three port-two way check valve. The pressure regulator (not shown) and the three port-two way check valve (not shown) are inserted in the actuating circuit. If the pressure regulator detects irregular pressure in the actuating circuit, the RUG apparatus 10 shuts down or the check valve is unseated, opening the valve to ambient conditions until the pressure at the air feed 45 stabilizes. A pressure gauge records the air pressure at the cylinder 42.

During the process, a vacuum chuck 40 secures the workpiece 12 in position by a vacuum pressure supplied at the vacuum feed 50. The vacuum chuck 40 includes an aluminum body with a ceramic face insert to guard against dampening of the ultrasonic energy during machining. The workpiece 12 fits into the vacuum chuck 40 such that its axis of rotation opposes and is parallel to that of the tool 18.

The vacuum chuck 40 is mounted in a rotating work head 38 located on a mechanical spindle (not shown) which is affixed to the apparatus 10. The rotating work head 38 rotates the vacuum chuck 40 and workpiece 12 coincidentally with the rotation of the surface finishing tool 18. The work head 38 rotates about an axis that is parallel to and diametrically opposes the tool's 18 axis of rotation. The work head's 38 axis of rotation is offset from the tool's 18 axis of rotation by a fixed distance. The offset distance varies based on the size of the tool and workpiece, and can be determined by simulation. Once the workpiece 12 is placed in the work head 38, it faces and is slightly offset from the rotational axis of the tool 18. This setup exposes the entire surface of the workpiece 12 to the action of the tool 18 thus removing the limitation that the workpiece 12 be smaller than the tool 18.

As stated in the example, the rotational speed of the rotating work head 38 is a key element of the RUG process. Increasing the rotation of the rotating work head 38 increases the MRR of the tool 18. An electric motor drives the rotating work head 38. The speed of the electric motor, and thus that of the work head, can be varied by a motor speed controller or other similar devices.

During the process, the surface finishing tool 18 has a tendency to heat-up. The coolant system 60 supplies cooling fluid to the surface finishing tool 18 during machining. The coolant system 60 includes a circulation pump 62, a coolant tank 64, and a coolant distribution circuit (not shown). The circulation pump 62 forces the coolant through the distribution circuit and internally through the surface finishing tool 18. In addition to cooling the tool 18, the coolant also washes away the swarf generated during the process. The circulated fluid returns to the coolant tank 64 where it is filtered and stored for later use.

The present invention will be better understood with reference to a specific example for machining a canasite substrate. Although canasite is not the preferred material because of problems with contaminants being trapped in the micropores of the substrate, experimentation on canasite disks, however, exemplifies the effects of the various parameters of the RUG process. Canasite is but one example of the type of ceramic material that may be machined using the present invention, and other ceramics may also be used. For example, initial experimentation shows that ceramic glass or other brittle material such as lithium-aluminosilicate, the preferred material, are more easily machined than canasite.

SPECIFIC EXAMPLE

Experiments conducted on canasite ceramic disks studied the influence of process parameters on material removal rate (MRR) and the mode of material removal, whether ductile/plastic or brittle. The experiments focused on evaluating the influence of the process parameters on the material removal rate and surface damage.

In rotary ultrasonic grinding (RUG), the material is machined by plastic deformation or shear as much as possible, keeping the extent of fracture to a minimum. Localized penetrations of the workpiece by hard, sharp particles (usually diamonds) embedded on a wheel surface create a complex combination of plastic flow (even in the most brittle materials) and fracture (see Marshall et al., "The Nature of Machining Damage in Brittle Materials", *Proc. R. Soc. Lond.* A 385, 461–475 (1983)). Preliminary experiments show that the machining rates of the apparatus and process of this invention are 6–10 times greater than with currently employed diamond grinding apparatuses and processes. Damage to the surface is within the acceptable limits, though because of the application there is a need to have a finishing process to achieve the required surface finish. The depth of penetration of surface damage and its subsequent subcritical crack growth are the principal factors controlling the strength and integrity of the ceramic workpiece (see Kirchner et al., "Fragmentation and Damage Penetration during Abrasive Machining of Ceramics", *National Bureau of Standards Special Publication* 562 (U.S. Government Printing Office, Washington, D.C. pp 23–42, (1979)).

Various parameters have variable levels and affect the performance of machining. These include abrasive particle shapes from most block-like to angular; friability and fracture toughness of the diamond particles, i.e., the ability of the grit to break down due to heat and pressure to provide a new cutting head; coolant flow; feed pressure; amplitude of vibrations; rotational speeds of the tool and workpiece; grit size; density of distribution of abrasive particles; and frequency of vibration.

Based on experience and experimental limitation, five process parameters were varied and their influence on the MRR analyzed using a $2^5$ fractional factorial design, as is known in the art. The process parameters studied were amplitude of vibration, rotational speed of the tool, rotational speed of the workpiece, feed pressure and grit size. To obtain maximum resolution, the four factor interaction between feed pressure, tool speed, chuck speed and the amplitude was allowed to vary in order to determine the resultant grit size. Table 1 contains the test ranges for each of the five process parameters.

TABLE 1

RANGE OF PARAMETERS

| Parameter | High (+1) | Low (−1) |
|---|---|---|
| Amplitude | 33 μm | 23 μm |
| Spindle Speed | 40% | 25% |
| Chuck Speed | 125 rpm | 75 rpm |
| Pressure | 34.5 psi | 33.5 psi |
| Grit Size | 170–200 | 270–333 |

Between each test run the tool was dressed with an aluminum oxide stick in order to maintain constant tool condition. The workpieces were machined to a depth of 101.6 μm (4 mils) and the time was recorded. Scanning electron microscope (SEM) observations were used to examine the extent of surface damage and estimate whether the dominant mode of material removal was ductile or brittle.

By assuming third and higher order interactions are absent, the main effects and the second order interactions were evaluated. With the help of the normal probability plot and residual plots the insignificant effects were filtered and the empirical model obtained is:

$$Y=b_0+b_2x_2+b_3x_3+b_4x_4+b_5x_5+b_{12}x_1x_2+b_{14}x_1x_4+b_{45}x_4x_5+b_{35}x_3x_5+b_{25}x_2x_5+b_{15}x_1x_5$$

where, b's are the influence coefficients.

Although there are numerous terms in the model, models with fewer terms had very poor predictive capabilities because of the significance of interaction effects. This model is up to ±10% accurate.

Figure 4:
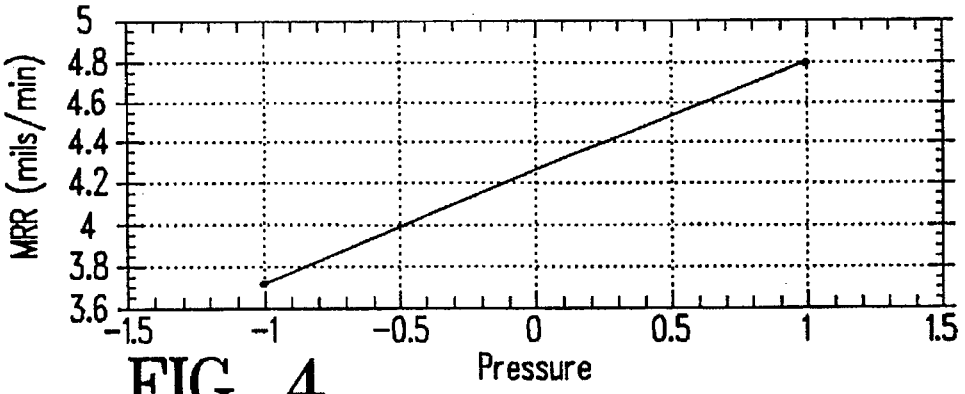
FIG. 4 is a graph showing the experimentally determined variation of material removal rate (MRR) with feed pressure.

Feed Pressure. The experiments showed that feed pressure may be the most important parameter both as a main effect and at an interaction level. As a main effect the MRR increases in direct proportion to the increase in feed pressure (FIG. 4). The penetration depth of the abrasive (δ) is related to the maximum force (F) between the tool and the workpiece as:

$$\delta \propto F^2$$

The above relationship is discussed in Pei et al., "A Mechanistic Approach to the Prediction of Material Removal Rates in Rotary Ultrasonic Machining", presented at Symposium on Advances in Nontraditional Manufacturing Processes Research and Development, ASME 1993 Winter Meeting, November 28–December 3, New Orleans, La. and to appear in *ASME JEI*. Once the feed pressure is set, the static forces during machining should not exceed the critical value; however, the maximum forces also depend upon the response of the hydraulic system. The feed pressure determines the maximum forces generated during machining and therefore the machining rates increase with increasing pressures (see Youseff, "Stock Removal Rate and Production Accuracy of Ultrasonically machined Holes in Glass and Sintered Carbides", *Bulletin of the Faculty of Engineering,* Alexandria University (1971)). High pressure causes a hammering action which damages the machined surface. Excessive static pressures can also increase tool wear (see Anantha Ramu et al., "Machining Performance of Toughened Zirconia Ceramic and Cold Company Alumina Ceramic in ultrasonic Drilling", *Journal of Mechanical Working Technology,* 20, pp 365–375 (1989)). A compromise therefore has to be struck in selecting the most feasible pressure level to achieve maximum material removal rates without causing uncontrolled damage to the surface being machined.

One advantage claimed for ultrasonic machining by other researchers is relatively low machining pressures. The experiments on canasite confirm this observation. The maximum feed pressure employed during the experiments (34.5 psi) creates a mere 10 pound load over the surface of the tool. This is advantageous not only in terms of the specific power of this process, but is also critical in maintaining the flatness of the workpiece surface. Low pressures do not necessitate the need for very rigid machine tool structures and deflection of the air spindle holding the workpiece is minimal even though the load is not centered.

Figure 14:
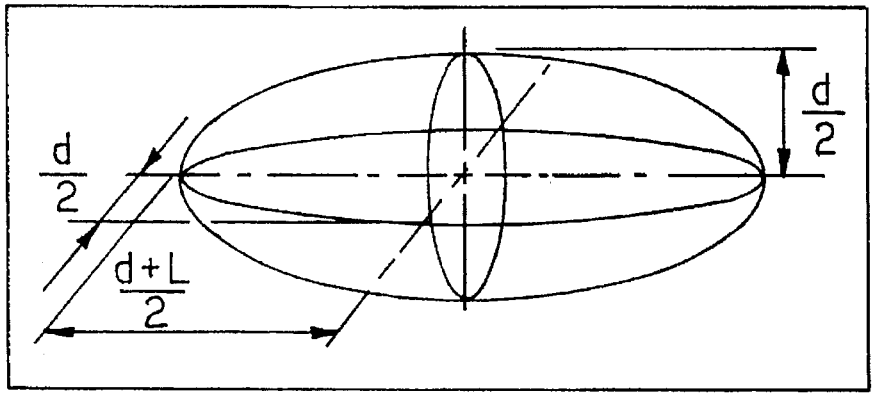
FIG. 14 is a graph showing the effective grit size during one ultrasonic cycle.

Chuck Speed. Increasing chuck speed increases the MRR (FIG. 5) because the contact length of the abrasive with the workpiece during one ultrasonic cycle increases. FIG. 14 shows that the effective size of the grit is (d+L)/2, where "d" is the diameter of the tool and "L" is the distance moved by the particle during penetration of the workpiece in one ultrasonic cycle due to the rotary motion of the tool. Therefore, if the chuck speed increases, L increases as shown in FIG. 5.

A disproportionately high chuck speed has the disadvantage of increasing the rate of tool glazing. In ultrasonic machining the continuous pounding of the workpiece chips off the diamond grits keeping them sharp. If the effective size of the abrasive becomes too large because of high workpiece speeds, the grinding action dominates over the ultrasonic hammering, which causes abrasive grits to shear along cleavage planes parallel to the plane of the workpiece. The abrasives become blunt and are said to be glazed. To summarize, at high chuck speeds the machining rates would be very high at first, but fall off at a very fast rate.

Another possible explanation for this behavior could be drawn from conventional grinding of ceramics. Spur observed that during grinding of Si-SiC samples that a reduction in the cutting speed from 35 m/s to 10 m/s resulted in increased material removal (See Spur et al., "Surface Layer Damage in the Grinding of Advanced Engineering Ceramics", 16 *NAMRI/SME* PP. 224–231 (1988)). For high cutting speeds the diamond grit cuts through the SiC grains; for low cutting speeds the grains are released from the matrix due to mechanical stressing. Experimentation showed that the chuck speed had the greatest influence on the rate of glazing the tool. At high speeds (3000 rpm) the tool could not machine beyond 50.8 μm (2 mils) and the workpiece surface had a consistent pattern scratched out on its surface by the blunt indenters. When the chuck speed was dropped to about 150 rpm the machining could go on comfortably until about 20 mils of the material had been removed, at an average rate of 63.5 μm (2.5 mils) per minute. During these experiments the chuck speeds were chosen so as to minimize glazing.

Figure 6:
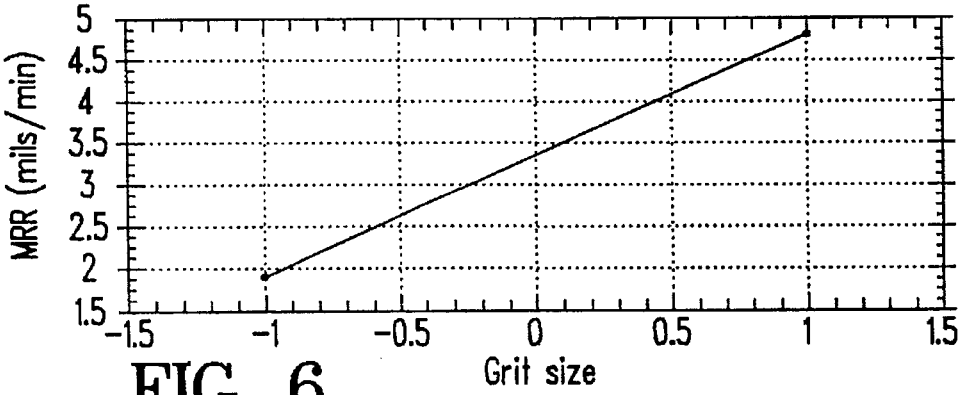
FIG. 6 is a graph showing the experimentally determined variation of MRR with grit size.

Grit Size. Grit size may have the strongest influence on the material removal rate. Experimentation showed that the larger the grit size, the higher the MRR (FIG. 6). Analysis of the machined surfaces showed a mixture of plastic deformation and brittle fracture with the 270–325 grit abrasives. With a 170–200 grit size tool the extent of brittle fracture increased somewhat. Use of a 60–80 grit size tool resulted in large scale intergranular fracture, making the product functionally useless. Often the cracks were easily perceivable with the naked eye. For these reasons grit projection and maintenance of this projection during the course of grinding is an essential prerequisite for the generation of reproducible quality surfaces on ceramic components (see Spur et al., "Surface Layer Damage in the Grinding of Advanced Engineering Ceramics", 16 *NAMRI/SME* PP. 224–231 (1988)). In practical applications where abrasive grains become less sharp during use the tendency toward damage penetration decreases despite the increased load on the diamond point as it wears (see Kirchner et al., "Fragmentation and Damage Penetration During Abrasive Machining of Ceramics", *National Bureau of Standards Special Publication* 562 U.S. Government Printing Office, Washington, D.C. pp. 23–42 (1979)). In terms of surface roughness values an average roughness ($R_a$) of 0.4064 μm (16 μin.) was obtained with 270–325 grit. Though these values were much higher than the requirement of 0.2 μm, the tool was still useful for roughing operations.

Figure 7:
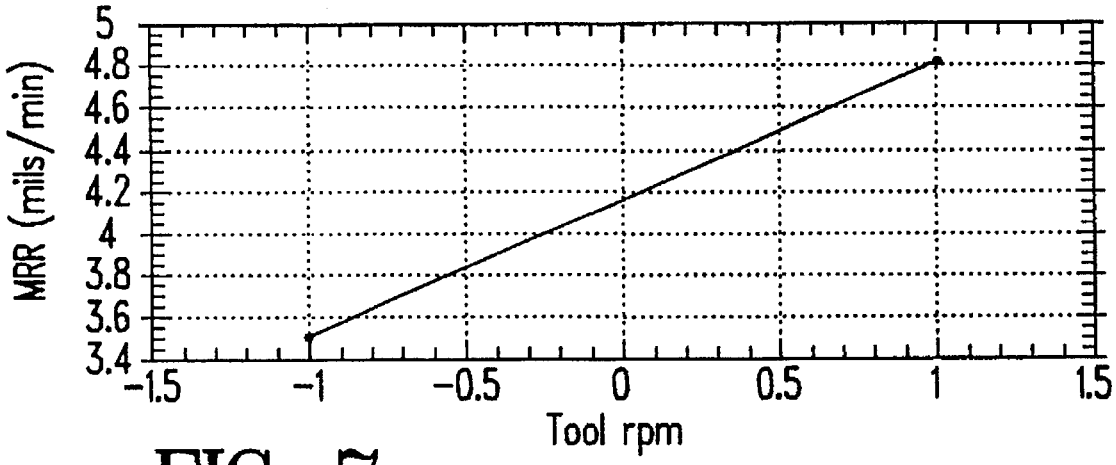
FIG. 7 is a graph showing the experimentally determined variation of MRR with tool speed.

Tool Speed. As represented in FIG. 7, increasing tool speed sharply increases the MRR because of the accelerated grinding action, which increases the effective size of the abrasive. Increasing tool speed would be expected to encourage glazing as in the case with increasing workpiece speeds. However, glazing of the tool was not a serious problem with increasing tool speeds.

Figure 8:
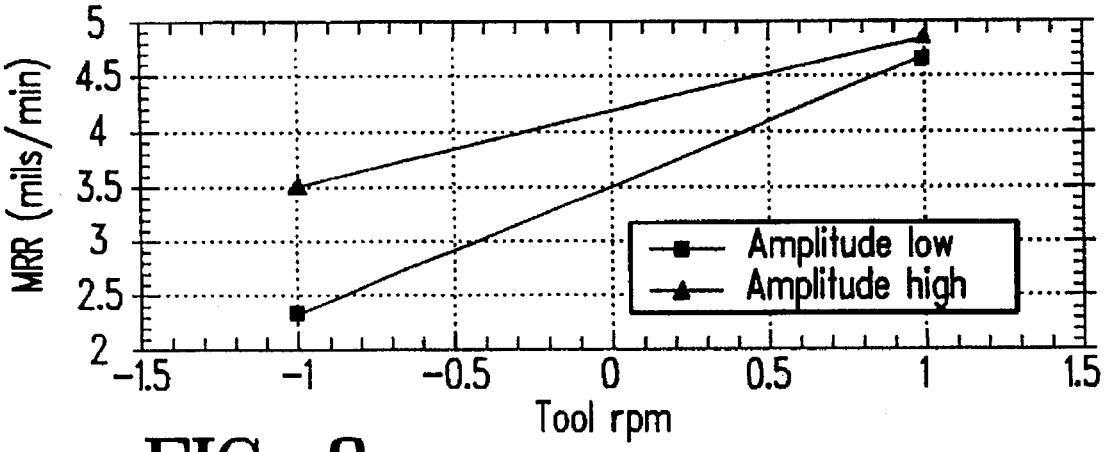
FIG. 8 is a graph showing the experimentally determined relationship between vibration amplitude and tool speed on MRR.

Amplitude. FIG. 8 illustrates the two factor interaction between tool speed and the vibration amplitude of the tool.

At low amplitudes, the period during which the grits and the workpiece are in contact is a greater part of the ultrasonic cycle. The major axis of the effective grit size, represented by (d+L)/2 in FIG. 14, therefore increases. The particles loosened because of the ultrasonic hammering are removed more effectively at low amplitudes, though the extent of loosening decreases with reduced amplitude.

Figure 9:
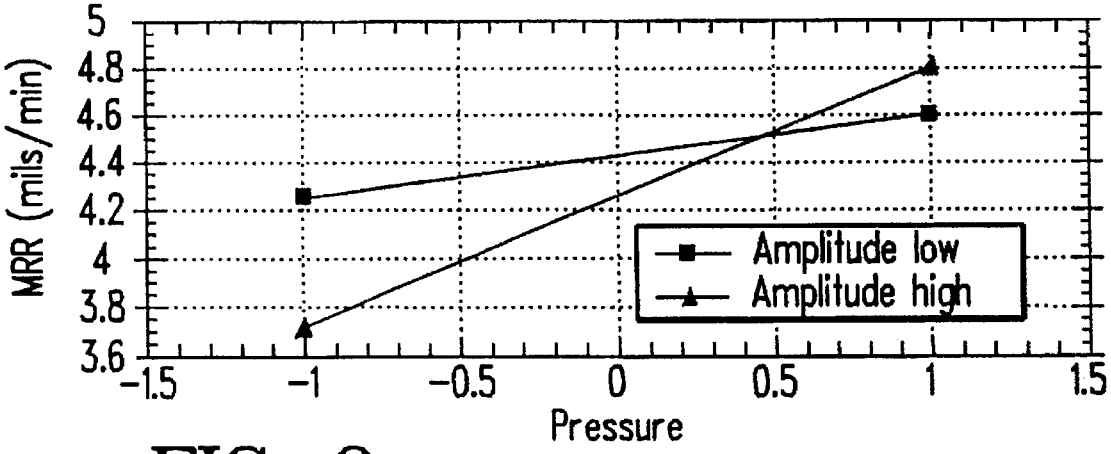
FIG. 9 is a graph illustrating the experimentally determined relationship between vibration amplitude and feed pressure on MRR.
Figure 15:
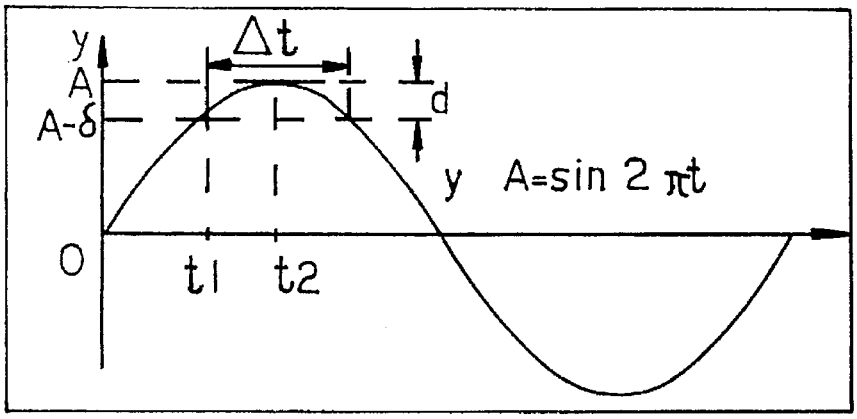
FIG. 15 is a graph showing the displacement of the tool during one ultrasonic cycle.

The MRR is higher at low pressures and amplitudes. As shown in FIG. 9, at higher pressures the MRR is higher for high amplitude. The equilibrium position of the workpiece is a function of the amplitude and pressure. FIG. 15 shows that equilibrium is reached when the impulse integrated over a portion of the ultrasonic cycle is equivalent to the static force on the system. At low pressures and high amplitudes the equilibrium position is at a critically low value preventing effective penetration of the abrasives into the workpiece, even at high amplitude. As the static force increases, the equilibrium position of the workpiece is pushed up, causing improved penetration of the grits resulting in higher amplitudes being more effective after some value of the static force/pressure.

Figure 10:
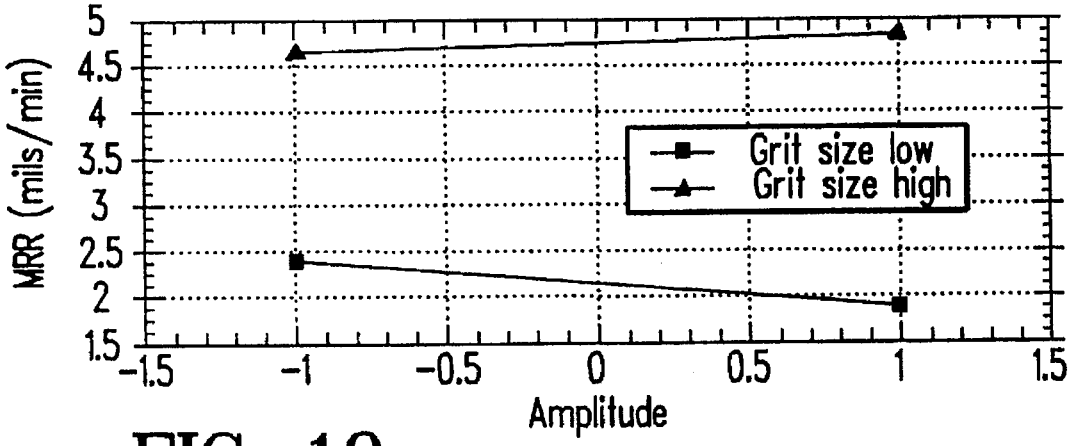
FIG. 10 is a graph demonstrating the experimentally determined relationship between grit size and vibration amplitude on MRR.

Interaction effects of the Parameters. Interaction effects involving grit size and amplitude and those involving grit size and tool speed both show similar trends. With increasing amplitudes, two opposing effects interact to give the output (MRR) (FIG. 10). MRR increases because of increasing energy input and decreases because of the drop in strength of the grits i.e., the friability improves. With small grit sizes, the latter effect dominates resulting in a drop in MRR with increasing amplitude. The larger grits do not shatter so easily and therefore the MRR increases with increasing amplitudes.

Figure 11:
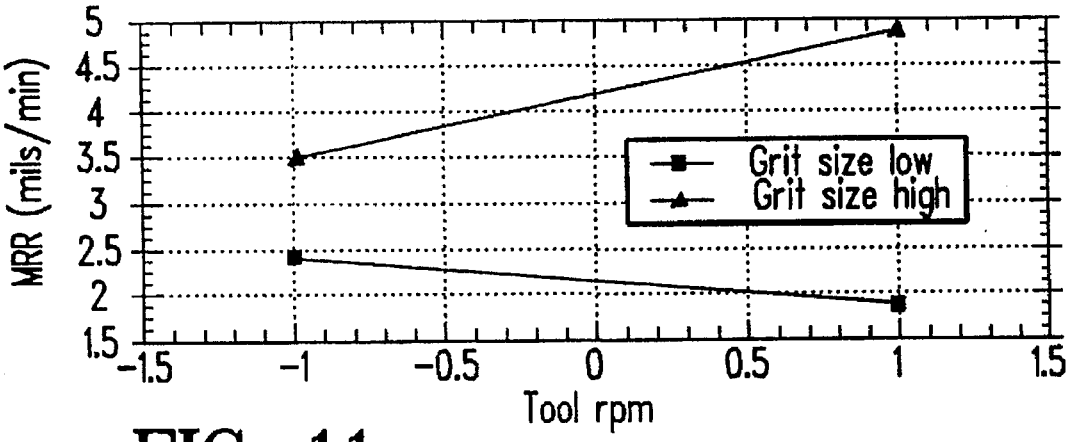
FIG. 11 is a graph showing the experimentally determined relationship between the grit size and tool speed on MRR.

Similarly considering the interaction involving the tool speed and the grit size (FIG. 11), the opposing effects are an increase in tool glazing with increasing tool speeds and an increase in MRR because of an increase in the effective contact length of the abrasive during one ultrasonic cycle. Small abrasives are more susceptible to glazing and therefore MRR decreases with increasing tool speed, whereas with large grit size increasing the tool speed results in more effective grinding action and improves the MRR.

Figure 12:
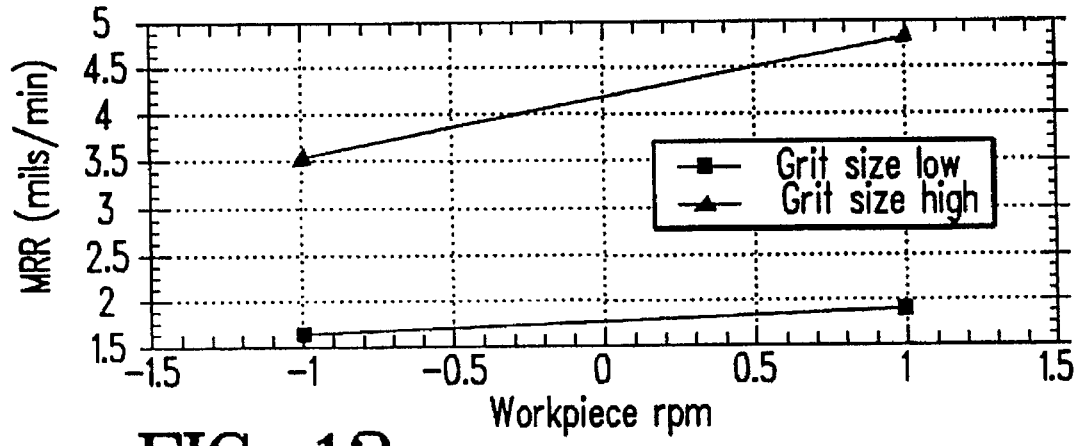
FIG. 12 is a graph illustrating the experimentally determined relationship between grit size and workpiece rotation on MRR.

As shown in FIG. 12, for larger grit sizes the increase in MRR with increasing workpiece rotational speed is greater than with smaller grit tools. This is because larger grits have a lesser tendency to glaze. Increasing workpiece speed causes increased material removal rates because of the increase in the effective size of the grit. The same thing happens with smaller grits, but these grits are at the same time degrading in that the effective projection of the grits from the face of the tool drops rapidly. This drop in effective projection counteracts with the increase in effective size to produce a more gradual gradient for small grits.

Figure 13:
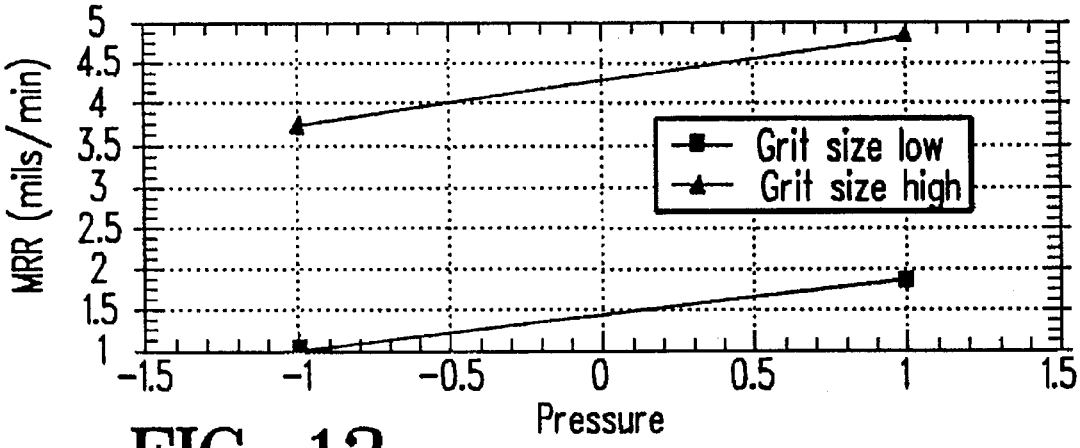
FIG. 13 is a graph illustrating the experimentally determined relationship between grit size and feed pressure on MRR.

The two level interaction between the pressure and the grit size is illustrated in FIG. 13. For the same pressure, the force per particle for larger grits is greater because the tools have the same volume density of abrasives. This keeps the MRR for large grits consistently high. As the pressure increases the tendency of the abrasives to glaze increases. The projection of the smaller grits from the matrix reduces faster than that for the larger grits, resulting in a faster MRR increase with pressure for larger grits than for smaller grits.

Although no quantitative relations could be determined between the surface damage and the process parameters, observation showed:

(i) The surface damage worsened with increase in grit size. FIGS. 16 and 17 are SEM photographs of (ii) The mode of material removal was dominantly brittle; however, regions with a plastic mode of material removal were found. The extent of failure from plastic mode removal increased with decreasing grit size.

(iii) Tool glazing resulted in extremely long cycle times accompanied by a flattening of parts of the workpiece surface. The surface showed signs of undergoing ductile failure with small penetration depths.

(iv) The virtual increase in grit size due to the rotary action of the tool is observable on the machined surface.

While both the apparatus and method of this invention have been described in connection with specific embodiments, it should be understood that numerous modifications in dimensions, materials and/or techniques could be made by persons of ordinary skill in this art without departing from the scope of this invention. Accordingly, the foregoing description is intended to be merely illustrative and is not limiting. The scope of the invention as claimed should be understood to include all those alternatives and modifications which the above specification and drawings would suggest or which would readily occur or be apparent to one skilled in the art upon study of the same.

What is claimed:

1. A rotary ultrasonic grinding apparatus for grinding a disc-shaped workpiece comprising:

a rotatable surface finishing tool, said surface finishing tool rotatable about an axis;

an ultrasonic vibration generator which vibrates the rotatable surface finishing tool at ultrasonic frequencies along its axis of rotation;

a rotatable work head adapted to accept and secure the disc-shaped workpiece in place, said work head rotatable about an axis parallel to, and offset from the axis of rotation of the rotatable surface finishing tool; and a feed system for bringing the rotatable surface finishing tool into contact with the workpiece.

2. The rotary ultrasonic grinding apparatus of claim 1 wherein the surface finishing tool includes a grinding diamond metal matrix abrasive bonded to its grinding face, the surface finishing tool selected to have a predetermined grit size and a predetermined weight.

3. The rotary ultrasonic grinding apparatus of claim 1 further comprising an ultrasonic spindle wherein the rotatable surface finishing tool is attached to the ultrasonic spindle and the ultrasonic vibration generator is located in the spindle.

4. The rotary ultrasonic grinding apparatus of claim 1 wherein the ultrasonic vibration generator is a piezoelectric transducer.

5. The rotary ultrasonic grinding apparatus of claim 1 wherein the feed system for bringing the rotatable surface finishing tool in contact with the workpiece is a constant pressure feed system comprising:

a work table mounted on one or more linear slides; and a means for propelling the work table over the slides.

6. The rotary ultrasonic grinding apparatus of claim 1 wherein the rotatable work head further comprises a vacuum chuck for holding the workpiece in place, the vacuum chuck incorporating an aluminum body having a ceramic face insert which guards against dampening of the ultrasonic energy.

7. The rotary ultrasonic grinding apparatus of claim 1 further including a coolant system comprising:

a coolant fluid distribution circuit which distributes coolant fluid through the rotating surface finishing tool;

a coolant pump which forces coolant fluid through the distribution circuit; and a coolant tank which stores the coolant fluid and which includes a filtering means to remove particulates and other contaminants from the coolant fluid.

8. A process for rotary ultrasonic grinding a disc-shaped workpiece comprising the steps of:

(a) providing a rotatable surface finishing tool having grinding abrasives bonded to its grinding face;

(b) rotating the tool about an axis;

(c) ultrasonically vibrating the tool along its axis of rotation;

(d) rotating the disc-shaped workpiece about an axis parallel to, and offset from, the tool's axis of rotation; and (e) placing the surface finishing tool into contact with the rotating workpiece.

9. The rotary ultrasonic grinding process of claim 8 further comprising the step of:

(a) providing a rotatable surface finishing tool having grinding abrasives bonded to its grinded face, the tool selected to have a grit size greater than 80.

10. The rotary ultrasonic grinding process of claim 8 further comprising the step of:

controlling the vibration amplitude of the surface finishing tool to achieve maximum material removal rates without causing uncontrolled damage to the surface to be machined.

11. The rotary ultrasonic grinding process of claim 8 further comprising the step of:

controlling the rotational speed of the surface finishing tool and the workpiece to achieve maximum material removal rates without causing uncontrolled damage to the surface to be machined.

12. The rotary ultrasonic grinding process of claim 8 further comprising the step of:

(g) placing the rotating disc-shaped workpiece and the rotating and vibrating surface finishing tool into contact using constant pressure.

* * * * *